United States Patent [19]

Shintaku

[11] 4,317,009

[45] Feb. 23, 1982

[54] COLDPROOF REFLEX HORN SPEAKER

[75] Inventor: Yoshishige Shintaku, Osaka, Japan

[73] Assignee: Ibuki Kogyo Co., Ltd., Osaka, Japan

[21] Appl. No.: 158,277

[22] Filed: Jun. 10, 1980

[30] Foreign Application Priority Data

Apr. 8, 1980 [JP] Japan ..... 55-47574[U]

[51] Int. Cl.[3] ..... H04R 1/00; H04R 9/06

[52] U.S. Cl. ..... 179/115.5 H; 179/1 E

[58] Field of Search ..... 179/1 R, 1 DD, 1 E, 179/115.5 R, 115.5 BS, 115.5 H

[56] References Cited

U.S. PATENT DOCUMENTS 2,058,555 10/1936 Betts et al. ..... 179/115.5 H 2,588,086 3/1952 Cole ..... 179/1 DD

*Primary Examiner*—George G. Stellar

*Attorney, Agent, or Firm*—Lackenbach, Siegel, Marzullo, Presta & Aronson

[57] ABSTRACT

A coldproof reflex horn speaker comprising a frame, a magnet mounted thereto, a diaphragm having a voice coil in its periphery, and inner and outer horns, which is provided with an electric heater device disposed to the outer horn in order to prevent ice and snow from being frozen thereon in cold circumstances.

3 Claims, 2 Drawing Figures

COLDPROOF REFLEX HORN SPEAKER

BACKGROUND OF THE INVENTION

This invention relates to a coldproof reflex horn speaker.

A reflex horn speaker posseses a good electroacoustic transducing efficiency and a structural strength, and hence it is utilized in a loudspeaker, siren, and the like.

However, when such a reflex horn speaker is used in cold circumstances such as the open air in winter of the cold region, it is attached by ice and snow in its surroundings. Thus, its characteristics are varied, for example, the resonant frequency of the horn is lowered, and the efficiency is depressed. Further, the good conditions for use it cannot be maintained.

SUMMARY OF THE INVENTION

Therefore, it is an object of the present invention to provide a coldproof reflex horn speaker free from the aforementioned defect, which is simple and stable.

According to the present invention there is provided a coldproof reflex horn speaker comprising (a) a frame, (b) a magnet mounted to the frame, (c) a diaphragm arranged in front of the magnet, whose end periphery is wound by a voice coil, and (d) inner and outer horns mounted to the frame, characterizing by an electric heater device disposed to the outer horn.

BRIEF DESCRIPTION OF DRAWINGS

In order that the present invention may be better understood, a preferred embodiment will now be described with reference to the accompanying drawings, in which.

DETAILED DESCRIPTION OF A PREFERRED EMBODIMENT

Figure 1:
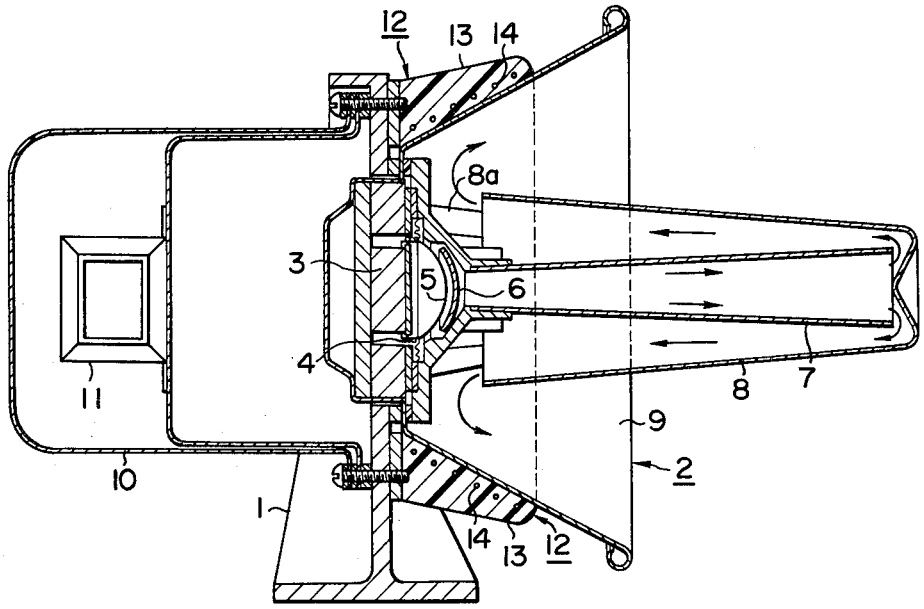
FIG. 1 is a central longitudinal cross-section of a coldproof reflex horn speaker according to the present invention.
Figure 2:
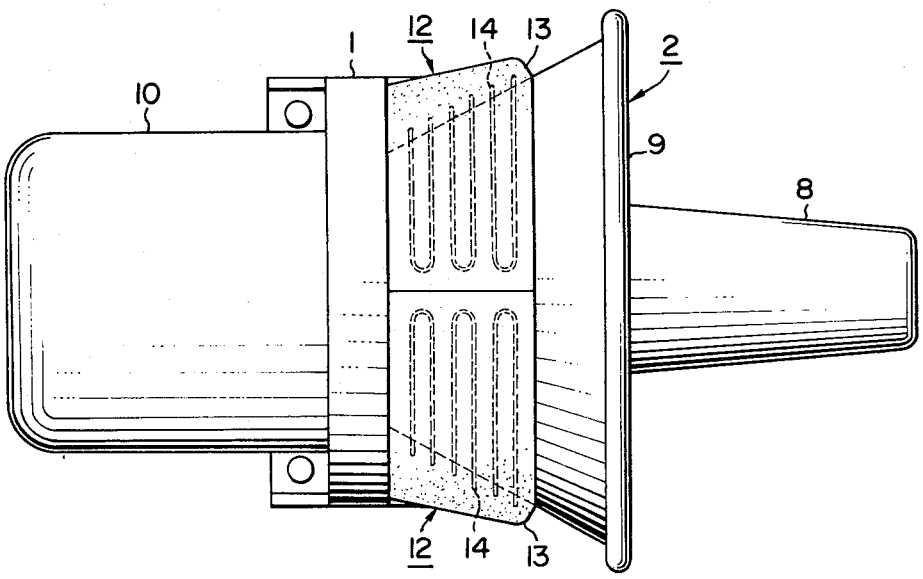
FIG. 2 is a top plan view of the coldproof reflex horn speaker in FIG. 1.

Referring now to FIGS. 1 and 2 of the drawings, there is shown a coldproof reflex horn speaker which is applied to a siren for use in a ship.

In front of a mount frame 1 is mounted a body 2 of the speaker. The body 2 comprises a magnet 3, a bowl-shape diaphragm 5 arranged in front thereof, whose end periphery is wound by a voice coil 4, an equalizer 6 arranged in front of the diaphragm 5, an inner horn 7 which is arranged in front of the equalizer 6 and projects forward, a tubular reflector 8 having a closed front end, which surrounds the inner horn 7 and is supported by several brackets 8*a* to the frame 1, and an outer horn 9 projecting outward and forward to the middle of the inner horn 7.

A detachable cover 10 is mounted to the rear of the frame 1 by bolts, and covers an impedance matching transducer 11 and other electric parts (not shown), which are mounted to the rear of the frame 1.

While this siren is working in cold circumstances, for example, in winter in a cold region, the temperature of the electric parts goes up and thus no ice nor snow is attached to the cover 10. However, the body 2 is attached with the ice and/or snow, and particularly in the base portion of the outer horn 9 is frozen water of the ice and/or snow melted on the cover 10.

An electric heater device 12 having a frustrum shape, which is mounted to the frame 1 and is divided into two insulator members 13, surrounds the outer base portion of the outer horn 9. Each insulator member 13 is made of an insulator having heatproof and coldproof properties such as asbestos, and electric heating wires 14 are embedded therein near the outer horn 9. The electric heating wires 14 are connected to an electric source (not shown).

The electric heater device may be disposed to the inner surface of the outer horn 9 or the outer surface of the reflector 8. Further, a temperature sensor may be attached to the outer horn 9 in order to control the temperature of the outer horn 9 automatically.

Although the present invention has been described with reference to a preferred embodiment in connection with the accompanying drawings, however, various changes and modifications can be made by those skilled in the art without departing from the scope of the present invention.

What is claimed is:

1. A coldproof reflex horn speaker comprising:

(a) a frame;

(b) a magnet mounted to the frame;

(c) a diaphragm arranged in front of the magnet, whose end periphery is wound by a voice coil; and (d) inner and outer horns mounted to the frame, characterizing by an electric heater device disposed to the outer horn.

2. A speaker as defined in claim 1, wherein the electric heater device comprises two insulator members and electric heating wires embedded therein.

3. A speaker as defined in claim 2, wherein each insulator member is made of asbestos.

* * * * *